US010653205B2

(12) United States Patent
Orand

(10) Patent No.: US 10,653,205 B2
(45) Date of Patent: May 19, 2020

(54) SOLE STRUCTURE FOR AN ARTICLE OF FOOTWEAR HAVING A NONLINEAR BENDING STIFFNESS

(71) Applicant: NIKE, Inc., Beaverton, OR (US)

(72) Inventor: Austin Orand, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/660,459

(22) Filed: Jul. 26, 2017

(65) Prior Publication Data

US 2018/0027922 A1 Feb. 1, 2018

Related U.S. Application Data

(60) Provisional application No. 62/367,851, filed on Jul. 28, 2016.

(51) Int. Cl.

| | |
|---|---|
| ***A43B 3/00*** | (2006.01) |
| ***A43B 13/14*** | (2006.01) |
| ***A43B 13/18*** | (2006.01) |
| ***A43B 13/04*** | (2006.01) |
| ***A43B 13/12*** | (2006.01) |

(52) U.S. Cl.

CPC ..... *A43B 13/141* (2013.01); *A43B 3/0063* (2013.01); *A43B 13/04* (2013.01); *A43B 13/12* (2013.01); *A43B 13/181* (2013.01); *A43B 13/186* (2013.01)

(58) Field of Classification Search

CPC ..... A43B 3/0057; A43B 3/0063; A43B 3/26; A43B 13/141; A43B 13/181; A43B 13/186

USPC ..... 36/97

See application file for complete search history.

(56) References Cited

U.S. PATENT DOCUMENTS

| | | | |
|---|---|---|---|
| 634,588 | A | 10/1899 | Roche |
| 1,964,406 | A | 6/1934 | Pellkofer |
| 2,072,785 | A | 3/1937 | Wulff |
| 2,342,188 | A | 2/1944 | Ghetz et al. |
| 2,342,466 | A | 2/1944 | Gordon |
| 2,379,139 | A | 6/1945 | Flink |
| 2,413,545 | A | 12/1946 | Cordi |
| 2,470,200 | A | 5/1949 | Wallach |

(Continued)

FOREIGN PATENT DOCUMENTS

| | | | |
|---|---|---|---|
| DE | 315919 | C | 11/1919 |
| DE | 202007000831 | U1 | 5/2007 |

(Continued)

*Primary Examiner* — Sharon M Prange

(74) *Attorney, Agent, or Firm* — Quinn IP Law

(57) ABSTRACT

A sole structure for an article of footwear comprises a first sole plate with a foot-receiving surface, a ground-facing surface opposite the foot-receiving surface, and an opening in the ground facing surface extending at least partway through the first sole plate and from a lateral side to a medial side of the first sole plate in a forefoot region. The first sole plate has a first wall at a forward extent of the opening, a second wall at a rear extent of the opening, and at least one tensile member disposed in the opening. The tensile member has a forward end fixed to the first wall, a rear end fixed to the second wall. A midportion of the at least one tensile member is transversely offset from both the forward end and the rear end by a first offset distance when the sole structure is in an unflexed, relaxed state.

19 Claims, 7 Drawing Sheets

(56) References Cited

U.S. PATENT DOCUMENTS

| | | | | |
|---|---|---|---|---|
| 2,478,664 | A | 8/1949 | Morrow et al. | |
| 2,537,123 | A | 1/1951 | Dowling, Sr. | |
| 2,640,283 | A | 6/1953 | McCord | |
| 2,922,235 | A | 1/1960 | Meltzer | |
| 3,039,207 | A | 6/1962 | Lincors | |
| 3,782,011 | A | 1/1974 | Fisher | |
| 4,026,045 | A | 5/1977 | Druss | |
| 4,255,877 | A | 3/1981 | Bowerman | |
| 4,391,048 | A | 7/1983 | Lutz | |
| 4,476,638 | A * | 10/1984 | Quacquarini | A43B 7/28 36/103 |
| 4,573,457 | A | 3/1986 | Parks | |
| 4,658,514 | A | 4/1987 | Shin | |
| 4,779,361 | A | 10/1988 | Kinsaul | |
| 4,839,972 | A | 6/1989 | Pack et al. | |
| 4,920,665 | A | 5/1990 | Pack et al. | |
| 4,936,028 | A | 6/1990 | Posacki | |
| 4,941,273 | A | 7/1990 | Gross | |
| 5,243,776 | A | 9/1993 | Zelinko | |
| 5,392,537 | A | 2/1995 | Goldberg | |
| 5,461,800 | A | 10/1995 | Luthi et al. | |
| 5,572,806 | A | 11/1996 | Osawa | |
| 5,729,912 | A * | 3/1998 | Gutkowski | A43B 3/26 36/93 |
| 6,092,309 | A * | 7/2000 | Edwards | A43B 7/1425 36/28 |
| 6,125,556 | A | 10/2000 | Peckler et al. | |
| 6,202,326 | B1 | 3/2001 | Hauglin | |
| 6,237,255 | B1 | 5/2001 | Renaudin et al. | |
| 7,100,308 | B2 | 9/2006 | Aveni | |
| 7,143,530 | B2 | 12/2006 | Hudson et al. | |
| 7,401,422 | B1 | 7/2008 | Scholz et al. | |
| 7,513,065 | B2 | 4/2009 | Kita et al. | |
| 8,074,377 | B2 * | 12/2011 | Nishiwaki | A43B 7/142 36/25 R |
| 8,117,770 | B2 | 2/2012 | Wong | |
| 8,365,444 | B2 * | 2/2013 | Youngs | A43B 13/141 36/102 |
| 8,505,220 | B2 * | 8/2013 | James | A43B 13/141 36/102 |
| 8,578,629 | B2 | 11/2013 | Bosomworth et al. | |
| 8,646,191 | B2 | 2/2014 | Amos et al. | |
| 9,179,733 | B2 | 11/2015 | Peyton et al. | |
| 10,226,097 | B2 | 3/2019 | Farris et al. | |
| 2001/0007177 | A1 | 7/2001 | Brown, Jr. et al. | |
| 2004/0091675 | A1 | 5/2004 | Yang | |
| 2005/0000115 | A1 | 1/2005 | Kimura et al. | |
| 2005/0039350 | A1 | 2/2005 | Hung | |
| 2006/0117600 | A1 | 6/2006 | Greene | |
| 2006/0254087 | A1 | 11/2006 | Fechter | |
| 2007/0039208 | A1 | 2/2007 | Bove et al. | |
| 2007/0266598 | A1 | 11/2007 | Pawlus et al. | |
| 2008/0066348 | A1 | 3/2008 | O'Brien et al. | |
| 2008/0263900 | A1 | 10/2008 | Determe et al. | |
| 2010/0139122 | A1 | 6/2010 | Zanatta | |
| 2010/0218397 | A1 | 9/2010 | Nishiwaki et al. | |
| 2011/0047816 | A1 | 3/2011 | Nurse | |
| 2011/0214313 | A1 | 9/2011 | James et al. | |
| 2012/0036739 | A1 | 2/2012 | Amos et al. | |
| 2012/0055047 | A1 | 3/2012 | Youngs | |
| 2013/0326911 | A1 | 12/2013 | Baucom et al. | |
| 2014/0182167 | A1 | 7/2014 | James et al. | |
| 2014/0223778 | A1 | 8/2014 | Horacek | |
| 2014/0250723 | A1 | 9/2014 | Kohatsu | |
| 2014/0366401 | A1 | 12/2014 | Cavaliere et al. | |
| 2015/0027005 | A1 | 1/2015 | Lee et al. | |
| 2015/0047222 | A1 | 2/2015 | Rushbrook | |
| 2015/0089841 | A1 | 4/2015 | Smaldone et al. | |
| 2015/0282557 | A1 * | 10/2015 | Kirk | A43B 13/141 36/31 |
| 2017/0079374 | A1 | 3/2017 | Farris et al. | |
| 2017/0079375 | A1 | 3/2017 | Bunnell et al. | |
| 2017/0079376 | A1 | 3/2017 | Bunnell et al. | |
| 2017/0079378 | A1 | 3/2017 | Farris et al. | |
| 2017/0127755 | A1 | 5/2017 | Bunnell et al. | |
| 2017/0340055 | A1 | 11/2017 | Schneider | |
| 2017/0340056 | A1 | 11/2017 | Bunnell et al. | |
| 2017/0354200 | A1 | 12/2017 | Orand et al. | |
| 2017/0367439 | A1 | 12/2017 | Fallon | |
| 2018/0042338 | A1 | 2/2018 | Orand | |

FOREIGN PATENT DOCUMENTS

| | | | |
|---|---|---|---|
| DE | 102012104264 | A1 | 11/2013 |
| EP | 1127504 | A2 | 8/2001 |
| EP | 1483981 | A1 | 12/2004 |
| EP | 2926678 | A2 | 10/2015 |
| FR | 892219 | A | 3/1944 |
| FR | 2974482 | A1 | 11/2012 |
| WO | 03075698 | A1 | 9/2003 |
| WO | 2006087737 | A1 | 8/2006 |
| WO | 2011005728 | A1 | 1/2011 |

* cited by examiner

SOLE STRUCTURE FOR AN ARTICLE OF FOOTWEAR HAVING A NONLINEAR BENDING STIFFNESS

CROSS REFERENCE TO RELATED APPLICATION

This application claims the benefit of priority to U.S. Provisional Application Ser. No. 62/367,851 filed Jul. 28, 2016, which is incorporated by reference in its entirety.

TECHNICAL FIELD

The present teachings generally include a sole structure for an article of footwear.

BACKGROUND

Footwear typically includes a sole structure configured to be located under a wearer's foot to space the foot away from the ground. Sole assemblies in athletic footwear are typically configured to provide cushioning, motion control, and/or resiliency.

DESCRIPTION

Figure 1:
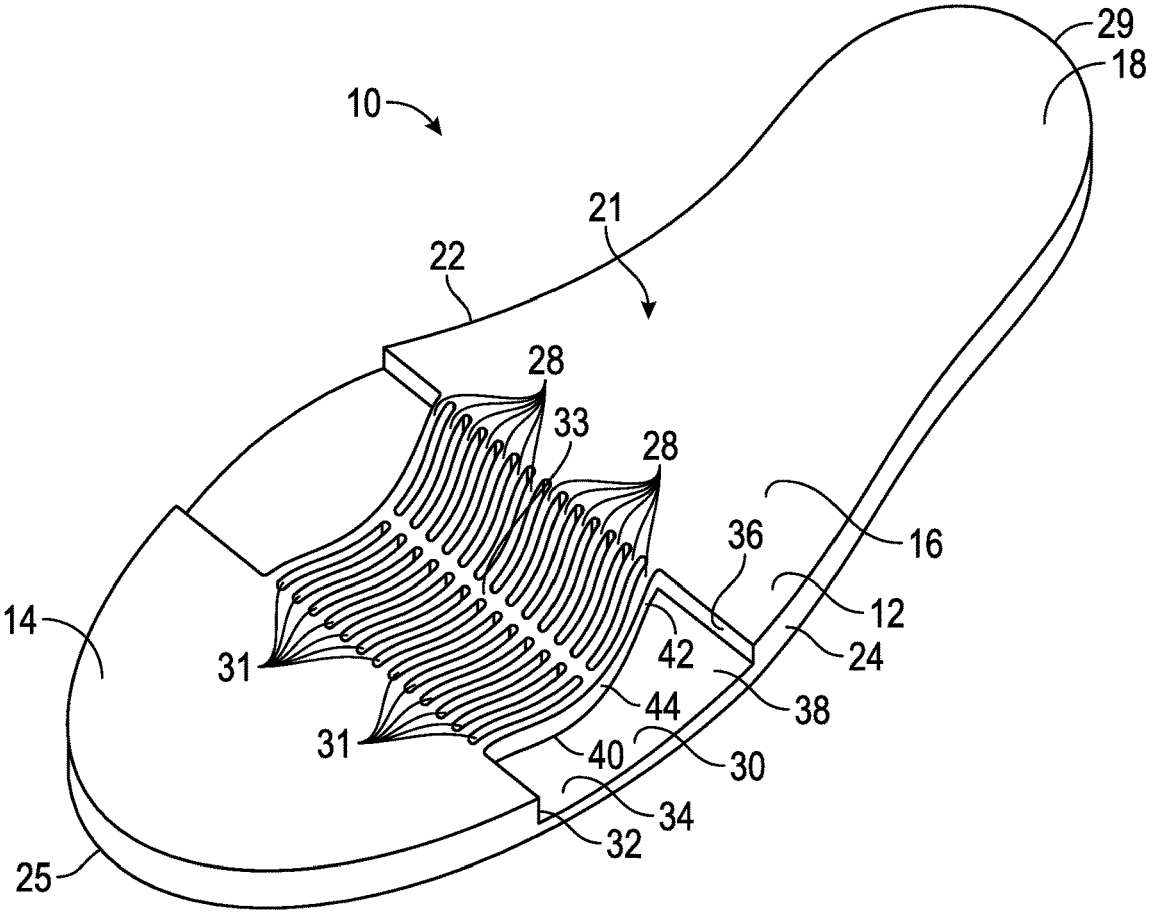
FIG. 1 is a schematic illustration in perspective view of a ground-facing surface of a sole structure for an article of footwear showing a plurality of tensile members and in an unflexed position.
Figure 2:
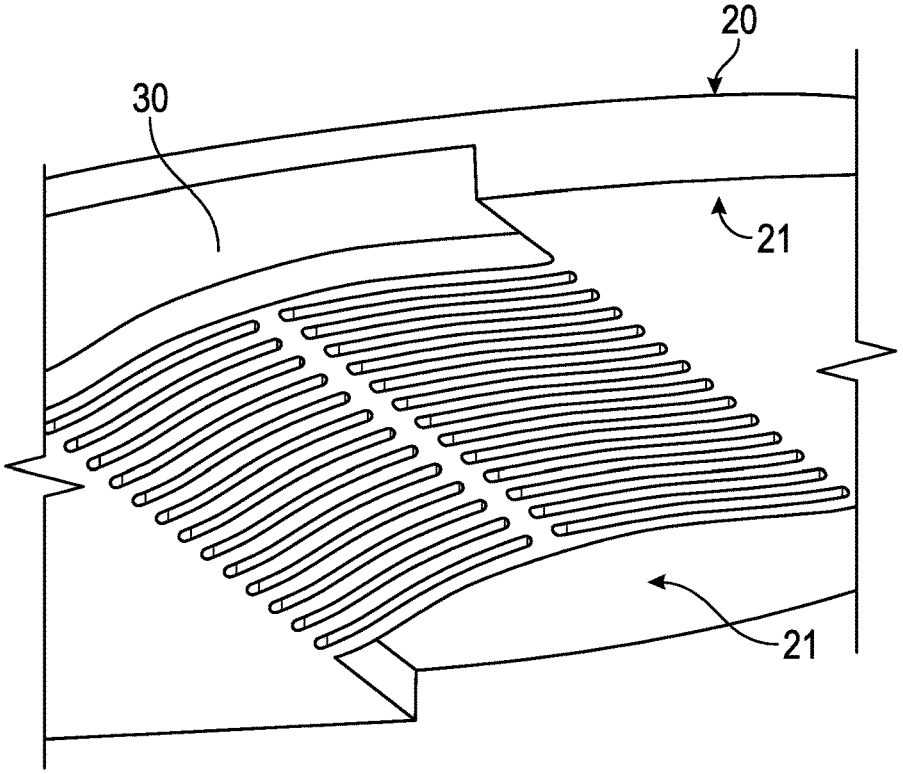
FIG. 2 is a schematic illustration in fragmentary perspective view of the sole structure of FIG. 1.

A sole structure for an article of footwear comprises a first sole plate that includes a forefoot region, a foot-receiving surface, and a ground-facing surface opposite the foot-receiving surface. An opening in the ground facing surface extends at least partway through the first sole plate, and extends from a lateral side of the first sole plate to a medial side of the first sole plate in the forefoot region. The first sole plate includes a first wall at a forward extent of the opening, a second wall at a rear extent of the opening, and at least one tensile member disposed in the opening. The at least one tensile member has a forward end fixed at the first wall, a rear end fixed at the second wall, and a midportion that extends across the opening from the forward end to the rear end. The midportion of the at least one tensile member is transversely offset from both the forward end and the rear end by a first offset distance when the sole structure is in an unflexed, relaxed state. Stated differently, each tensile member may have a curvilinear posture with a transversely-offset midportion when the sole structure is in the unflexed, relaxed state.

In an embodiment, the midportion of the at least one tensile member is transversely offset from both the forward end and the rear end toward the lateral side of the first sole plate when the sole structure is in the unflexed, relaxed state. Alternatively, the at least one tensile member could be transversely offset from both the forward end and the rear end toward the medial side of the first sole plate when the sole structure is in the unflexed, relaxed state.

The midportion of the at least one tensile member may be transversely offset from both the forward end and the rear end by a second offset distance less than the first offset distance when the sole structure is dorsiflexed in the forefoot region. Stated differently, the at least one tensile member may tend to straighten under dorsiflexion.

In an embodiment, a longitudinal axis of the at least one tensile member lies in a common plane from the first end to the second end when the sole structure is in the unflexed, relaxed state. The at least one tensile member may be spaced apart from a lower surface of the first sole plate in the opening when the sole structure is in the unflexed, relaxed state.

In an embodiment, the at least one tensile member is secured to the first sole plate only at the forward end and at the rear end, and the midportion extends freely from the first sole plate between the forward end and the rear end.

Optionally, the first sole plate may further include a midfoot region, and may include a heel region. The first sole plate may be an outsole, a midsole, an insole, or a unisole.

The at least one tensile member may be a plurality of tensile members, which may be, but need not necessarily be equally spaced from one another and/or substantially identical to one another. For example, the plurality of tensile members may be an array of substantially identical, equally spaced-apart tensile members Optionally, the sole structure includes a strut that is connected to two or more of the plurality of tensile members and extends transversely between adjacent ones of the plurality of tensile members. The strut may be elongated, and may have a longitudinal axis generally parallel to each of the first wall and the second wall.

In an embodiment, the sole structure may further include a second sole plate secured to the foot-receiving surface of the first sole plate both forward of the at least one tensile member and rearward of the at least one tensile member, and extending across the opening adjacent the at least one tensile member.

The sole structure may have a first bending stiffness in a first portion of a flexion range of the sole structure, and a second bending stiffness greater than the first bending stiffness in a second portion of the flexion range. The second portion of the flexion range may include flex angles greater than in the first portion of the flexion range.

In an embodiment, the first portion of the flexion range includes flex angles of the sole structure less than a first predetermined flex angle, the second portion of the flexion range includes flex angles of the sole structure greater than or equal to the first predetermined flex angle, and the sole structure has a change in bending stiffness at the first predetermined flex angle.

In an embodiment, a sole structure for an article of footwear comprises a sole plate that includes a forefoot region, a foot-receiving surface, a ground-facing surface opposite the foot-receiving surface, and a recess in the ground facing surface extending only partway through the sole plate and from a lateral side of the sole plate to a medial side of the sole plate in the forefoot region. The sole plate includes a first wall at a forward extent of the recess, a second wall at a rear extent of the recess, and a plurality of tensile members disposed in the recess. Each of the plurality of tensile members is fixed to the sole plate at the first wall and at the second wall, extends freely across the recess from the first wall to the second wall, and has a curvilinear posture with a transversely-offset midportion when the sole structure is in an unflexed, relaxed state.

Each of the plurality of tensile members may have a forward end, a rear end, and a midportion that is transversely offset from both the forward end and the rear end by a first distance when the sole structure is in the unflexed, relaxed state, and by a second distance less than the first distance when the sole structure is dorsiflexed in the forefoot region.

The sole structure may include a strut connected to each of the plurality of tensile members and extending transversely between two or more of the plurality of tensile members. The plurality of tensile members may be spaced apart from the ground-facing surface of the sole plate in the recess when the sole structure is in the unflexed, relaxed state. The sole structure may have a first bending stiffness in a first portion of a flexion range of the sole structure, and a second bending stiffness greater than the first bending stiffness in a second portion of the flexion range. The second portion of the flexion range may include flex angles greater than in the first portion of the flexion range.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., may be used descriptively relative to the figures, without representing limitations on the scope of the invention, as defined by the claims.

Figure 7:
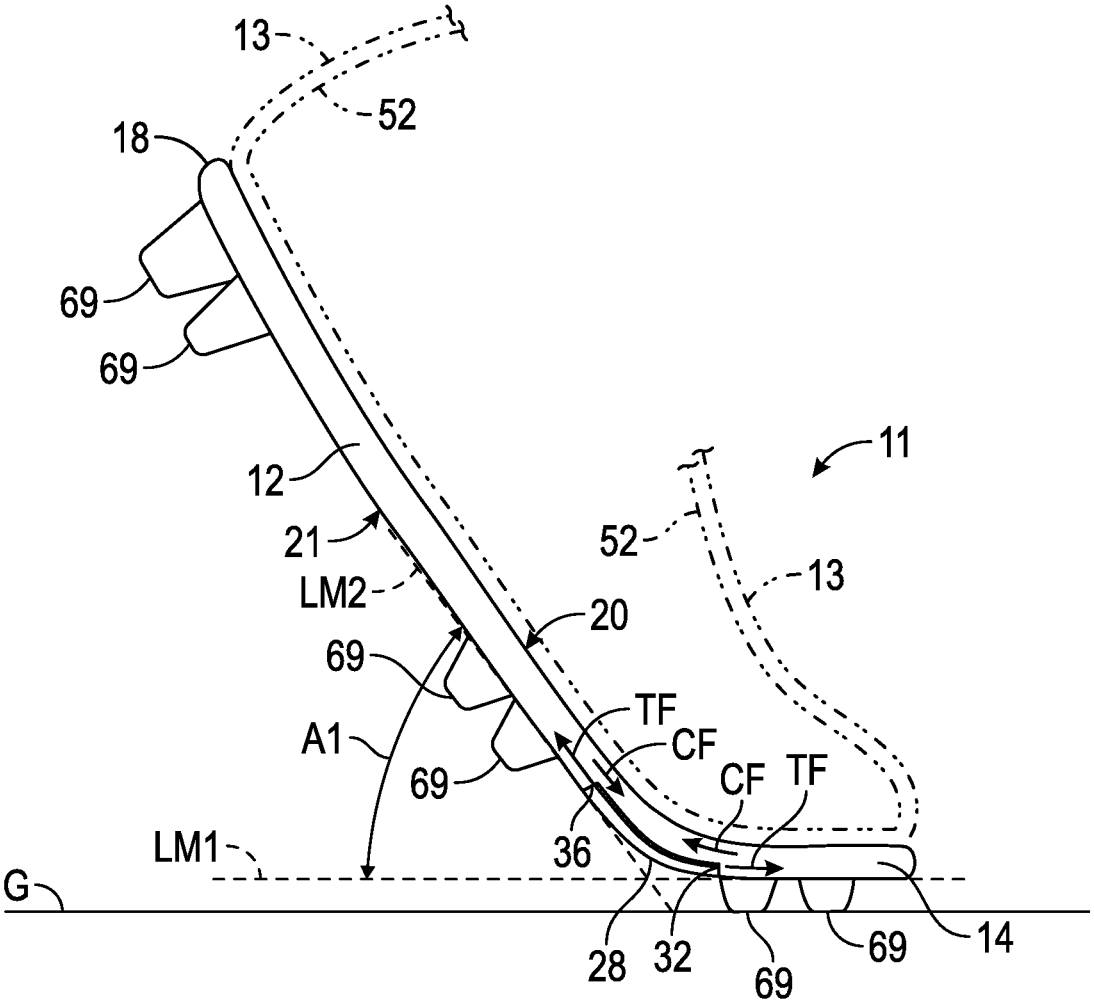
FIG. 7 is a schematic cross-sectional illustration of the sole structure of FIG. 1 flexed at a first predetermined flex angle.

Referring to the drawings, wherein like reference numbers refer to like components throughout the views, FIG. 1 shows a sole structure 10 for an article of footwear 11 shown in FIG. 7. The sole structure 10 has a resistance to flexion that increases with increasing dorsiflexion of the forefoot region 14 of the sole structure 10 (i.e., flexing of the forefoot region 14 in a longitudinal direction as discussed herein). As further explained herein, at least one tensile member 28 is fixed in an opening 30 of a first sole plate 12 of the sole structure 10, and has a midportion 44 transversely offset from a forward portion 40 and a rear portion 42 when in an unflexed position. Due to the at least one tensile member 28, the sole structure 10 provides an increase in bending stiffness when the sole structure 10 is dorsiflexed at a first predetermined flex angle A1. More particularly, the sole structure 10 has a bending stiffness that is a piecewise function with a change at a first predetermined flex angle A1. The bending stiffness is tuned by the selection of various structural parameters discussed herein that determine the first predetermined flex angle A1. As used herein, "bending stiffness" may be used interchangeably with "bend stiffness".

Referring to FIGS. 1-7, the sole structure 10 includes a first sole plate 12, and may include one or more additional plates, layers, or components, as discussed herein. The article of footwear 11 includes an upper 13 (shown in phantom in FIG. 7). The first sole plate 12 is configured to be operatively connected to the upper 13 as discussed herein. The upper 13 may incorporate a plurality of material elements (e.g., textiles, foam, leather, and synthetic leather) that are stitched or adhesively bonded together to form an interior void for securely and comfortably receiving a foot 52, represented in phantom in FIG. 7. The material elements may be selected and located with respect to the upper 13 in order to selectively impart properties of durability, air-permeability, wear-resistance, flexibility, and comfort, for example. An ankle opening provides access to the interior void. In addition, the upper 13 may include a lace or other tightening mechanism that is utilized to modify the dimensions of the interior void, thereby securing the foot 52 within the interior void and facilitating entry and removal of the foot 52 from the interior void. For example, a lace may extend through apertures in upper 13, and a tongue portion of the upper 13 may extend between the interior void and the lace. The upper 13 may exhibit the general configuration discussed above or a different configuration. Accordingly, the structure of the upper 13 may vary significantly within the scope of the present teachings.

The sole structure 10 is secured to the upper 13 and has a configuration that extends between the upper 13 and the ground G (included in FIG. 7). The first sole plate 12 may or may not be directly secured to the upper 13. In addition to attenuating ground reaction forces (i.e., providing cushioning for the foot 52), sole structure 10 may provide traction, impart stability, and limit various foot motions.

Figure 3:
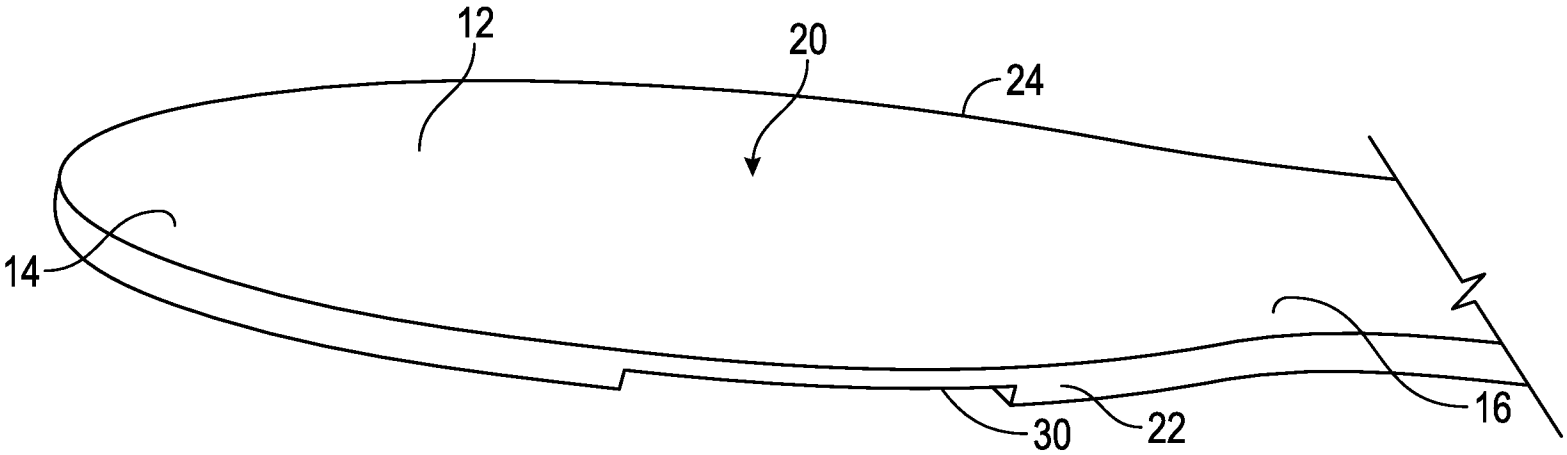
FIG. 3 is a schematic illustration in fragmentary perspective view of a foot-receiving surface of the first sole plate of the sole structure of FIG. 1.

In the embodiment shown in FIG. 1, the first sole plate 12 is a full-length, first sole plate 12 that has a forefoot region 14, a midfoot region 16, and a heel region 18. As shown in FIG. 3, the first sole plate 12 provides a foot-receiving surface 20 (also referred to as a foot-facing surface) that extends over the forefoot region 14, the midfoot region 16, and the heel region 18 (shown in FIG. 7). The foot-facing surface 20 supports the foot 52 but need not be in contact with the foot 52. For example, an insole, midsole, strobel, or other layers or components may be positioned between the foot 52 and the foot-facing surface 20.

As shown, the first sole plate 12 extends from a medial side 22 to a lateral side 24. As used herein, a lateral side of a component for an article of footwear, including the lateral side 24 of the first sole plate 12, is a side that corresponds with an outside area of the human foot 52 (i.e., the side closer to the fifth toe of the wearer). The fifth toe is commonly referred to as the little toe. A medial side of a component for an article of footwear, including the medial side 22 of the first sole plate 12, is the side that corresponds with an inside area of the human foot 52 (i.e., the side closer to the hallux of the foot of the wearer). The hallux is commonly referred to as the big toe. Both the lateral side 22 and the medial side 24 extend from a foremost extent 25 to a rearmost extent 29 of a periphery of the first sole plate 12.

The term "longitudinal," as used herein, refers to a direction extending along a length of the sole structure 10, e.g., extending from the forefoot region 14 to the heel region 18 of the sole structure 10. The term "forward" is used to refer to the general direction from the heel region 18 toward the forefoot region 14, and the term "rearward" is used to refer to the opposite direction, i.e., the direction from the forefoot region 14 toward the heel region 18. The term "anterior" is used to refer to a front or forward component or portion of a component. The term "posterior" is used to refer to a rear or rearward component or portion of a component.

The heel region 18 generally includes portions of the first sole plate 12 corresponding with rear portions of a human foot, including the calcaneus bone, when the human foot is supported on the sole structure 10 and is a size corresponding with the sole structure 10. The forefoot region 14 generally includes portions of the first sole plate 12 corresponding with the toes and the joints connecting the metatarsal bones with the phalange bones of the human foot (interchangeably referred to herein as the "metatarsal-phalangeal joints" or "MPJ" joints). The midfoot region 16 generally includes portions of the first sole plate 12 corresponding with an arch area of the human foot, including the navicular joint. Regions 14, 16, 18 are not intended to demarcate precise areas of the sole structure 10. Rather, regions 14, 16, 18 are intended to represent general areas relative to one another, to aid in the following discussion. In addition to the sole structure 10, the regions 14, 16, 18, and medial and lateral sides 22, 24 may also be used to describe relative portions of the upper 13, the article of footwear 11, and individual components thereof.

The first sole plate 12 is referred to as a plate, but is not necessarily flat and need not be a single component but instead can be multiple interconnected components. For example, both an upward-facing portion of the foot-facing surface 20 and the opposite ground-facing surface 21 may be pre-formed with some amount of curvature and variations in thickness when molded or otherwise formed in order to provide a shaped footbed and/or increased thickness for reinforcement in desired areas. For example, the first sole plate 12 could have a curved or contoured geometry that may be similar to the lower contours of the foot 52. For example, the first sole plate 12 may have a contoured periphery that slopes upward toward any overlaying layers, such as a midsole component or the upper 13.

The first sole plate 12 may be entirely of a single, uniform material, or may have different portions comprising different materials. For example, a first material of the forefoot region 14 can be selected to achieve a particular bending stiffness in the forefoot region 14, while a second material of the midfoot region 16 and the heel region 18 can be a different material that has little effect on the bending stiffness of the forefoot region 14. By way of non-limiting example, the different materials can be over-molded onto or co-injection molded with one another. Example materials for the first sole plate 12 include durable, wear resistant materials such as but not limited to nylon, thermoplastic polyurethane, or carbon fiber.

In the embodiment shown, the first sole plate 12 may be an inner board plate, also referred to as an inner board, an insole board, or a lasting board. In other embodiments, the first sole plate 12 may be an outsole. Still further, the first sole plate 12 could be a midsole plate or a unisole plate, or may be one of, or a unitary combination of any two or more of, an outsole, a midsole, and/or an insole (also referred to as an inner board plate).

The first sole plate 12 has an opening 30 in the ground-facing surface 21 extending at least partway through the first sole plate 12 toward the foot-receiving surface 20 as shown in FIG. 3. As used herein, an "opening" in the ground-facing surface 21 may extend only partway through the first sole plate 12, such as opening 30, in which case the opening may be referred to as a recess. In other embodiments, an opening in the ground-facing surface of the first sole plate may extend entirely through the first sole plate from the ground-facing surface to the foot-receiving surface, such as opening 130 in the sole plate 112 of FIG. 9. In the embodiment of FIG. 1, the opening 30 is a recess extending upward from the ground facing surface 21 toward the foot-receiving surface 20, but not entirely through to the foot-receiving surface 20 of the first sole plate 12. The opening 30 extends from the lateral side 24 of the first sole plate 12 to the medial side 22 of the first sole plate 12 in the forefoot region 14. The first sole plate 12 has a first wall 32 at a forward extent 34 of the opening 30, and a second wall 36 at a rear extent 38 of the opening 30. Stated differently, the front wall 32 defines the forwardmost extend of the opening 30, and the second wall 36 defines a rearmost extent of the opening 30.

A plurality of tensile members 28 are arranged in an array and disposed in the opening 30. In the embodiments shown, the tensile members 28 are substantially identical, and equally spaced apart from one another by gaps 31. In other embodiments, the tensile members need not be identical, and the gaps need not be evenly spaced. As shown, a lower surface of the tensile members 28 is flush with immediately forward and rearward portions of the first sole plate 12.

A strut 33 connects the midportions 44 of each of the tensile members. The strut 33 extends transversely between adjacent ones of the plurality of tensile members 28. The strut is elongated and has a center axis CA generally parallel with the first wall 32 and with the second wall 36. The strut 33 is optional, and serves to keep the tensile members 28 moving in unison, as discussed herein. The strut 33 also helps prevent the individual tensile members 28 from twisting about their longitudinal axes as they move. In other embodiments, the tensile members 28 may function as described herein without a strut 33 interconnecting them.

Each tensile member 28 has a forward portion 40 fixed at the first wall 32, a rear portion 42 fixed at the second wall 36, and a midportion 44 that extends from the forward portion 40 to the rear portion 42. Each tensile member 28 has a forward end 41 fixed to the first wall 32 and a rear end 43 fixed to the second wall 36 and is continuous between the forward end 41 and the rear end 43. The tensile member 28 extends across the opening 30 from the first wall 32 to the rear wall 36. As used herein, for purposes of discussion, the forward portion 40, the midportion 44, and the rear portion 42 of each tensile member 28 may each represent thirds of the tensile member 28, but the relative proportions may be different.

Figure 4:
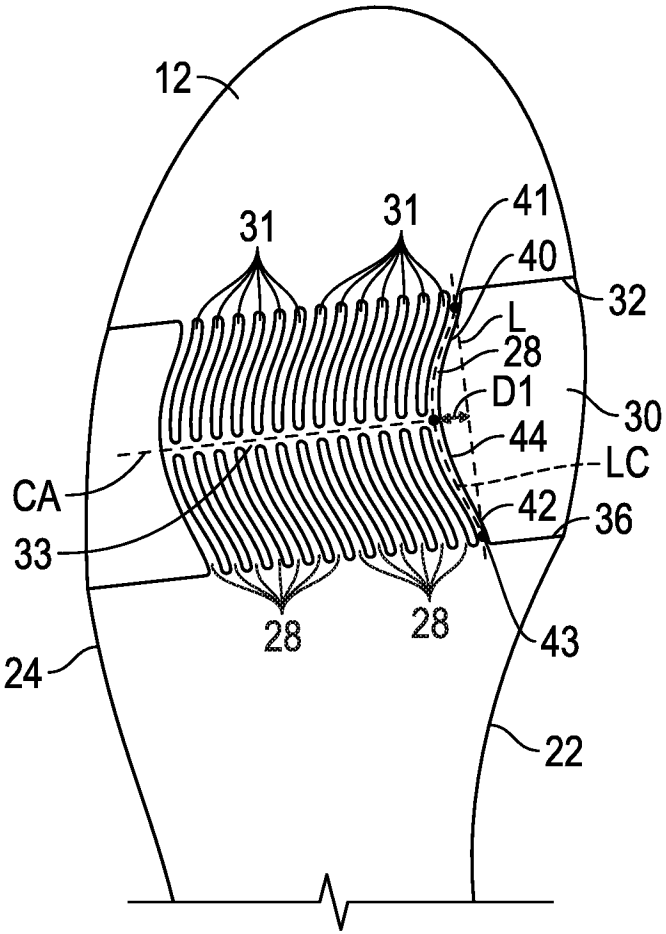
FIG. 4 is a schematic illustration in fragmentary bottom view of the sole structure of FIG. 1 in the unflexed position.

As best shown in FIG. 4, the midportion 44 of each tensile member 28 is transversely offset from both the forward end 41 and the rear end 43 by a first offset distance D1 when the sole structure 10 is in an unflexed, relaxed state. For purposes of discussion, the first offset distance D1 is the furthest distance from a longitudinal axis LC of a tensile member 28 perpendicular to a line L that extends through the center of the tensile member 28 at the forward end 41 (fixed to the front wall 32) and through the center of the tensile member at the rear end 43 (fixed to the rear wall 36). Specifically, in the embodiment shown, the midportion 44 of each tensile member 28 is transversely offset from both the forward end 41 and the rear end 43 toward the lateral side 24 of the first sole plate 12 when the sole structure 10 is in the unflexed, relaxed state. Alternatively, the midportion 44 could instead be transversely offset toward the medial side 22. The tensile members 28 thus have a curvilinear posture with transversely-offset midportions when the sole structure is in an unflexed, relaxed state.

Figure 6:
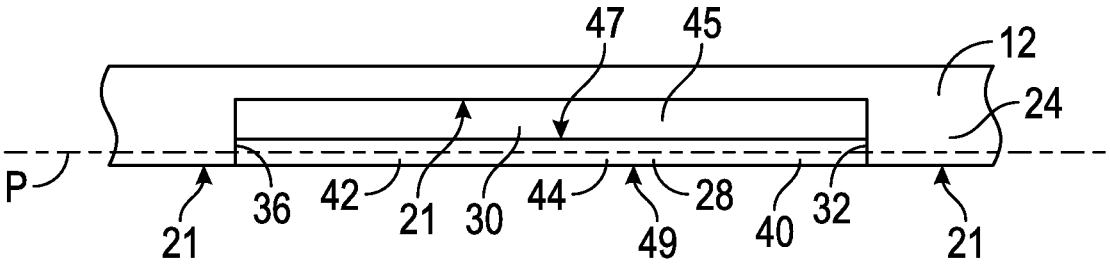
FIG. 6 is a schematic illustration in fragmentary side view of the sole structure of FIG. 1.

As best shown in FIG. 6, each tensile members 28 (i.e., the forward portion 40 including the forward end 41, the midportion 44, and the rear portion 42 including the rear end 43 of each of the tensile members 28) lies in a common plane P extending between the first wall 32 and the second wall 36 when the sole structure 10 is in the unflexed, relaxed state. In FIG. 6, the common plane P lies perpendicular to the page. It should be appreciated, however, that the sole plate 12 may have a curved or contoured geometry as discussed herein, even though the tensile members 28 lie in a common plane. In other embodiments, the sole structure 10 may have a curve in the forefoot region 14 significant enough that the tensile member 28 does not lie in a common plane from the forward portion 40 to the rear portion 42.

The tensile members 28 are secured to the first sole plate 12 only at the forward end 41 and at the rear end 43, and the midportion 44 extends freely from the first sole plate 12 between the forward portion 40 and the rear portion 42. Stated differently, the tensile members 28 are suspended in the opening 30 between the first wall 32 and the rear wall 36 and are not connected to the ground-facing surface 21 of the first sole plate 12 along their lengths, such as at their midportions 44. The tensile members 28 may be the same material as the first sole plate 12 and may be uniformly formed therewith. Alternatively, the tensile members 28 may be a different material than the first sole plate 12 and secured thereto after the sole plate 12 is formed. In either instance, the tensile members 28 are sufficiently stiff that they do not sag below the portions of the ground-facing surface 21 of the first sole plate 10 immediately forward of and immediately rearward of the opening 30 when in the relaxed, unflexed state. Instead, the tensile members 28 maintain their curvilinear position in the relaxed, unflexed state while disposed in the common plane P and extending freely across the opening 30 from the first wall 32 to the second wall 36.

Figure 5:
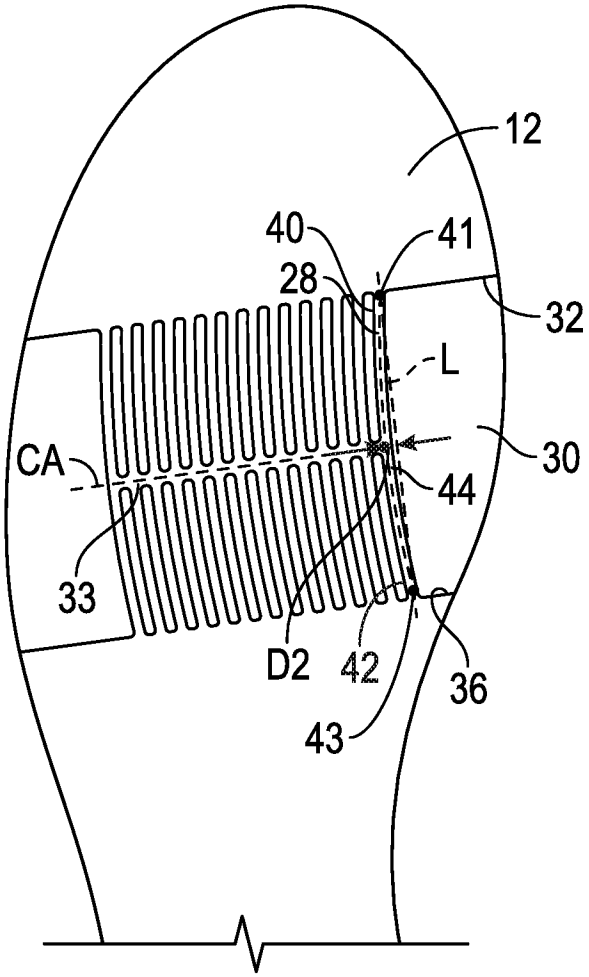
FIG. 5 is a schematic illustration in fragmentary bottom view of the sole structure of FIG. 1 in a flexed position.

FIG. 5 illustrates the sole structure 10 when dorsiflexed at the first predetermined flex angle A1 when the sole structure 10 is flexed in a longitudinal direction by dorsiflexion of the foot 52, bending of the sole structure 10 is about a bend axis above the foot-receiving surface 20 of the first sole plate 12, causing the front wall 32 and the rear wall 36 to move apart from one another as the sole structure 10 bends, as indicated by the further distance between the walls 32, 36 in FIG. 5 than in FIG. 4. As the walls 32, 36 move apart with increasing dorsiflexion of the sole structure 10, the forward and rear portions 40, 42 of the tensile members 28 fixed to the respective walls 32, 36 likewise move apart from one another, causing the tensile members 28 to be placed in tension and move toward a straighter posture. More specifically, the midportions 44 of the tensile members 28 move transversely to a position closer to alignment with the forward and rear portions 40, 42. For example, as shown in FIG. 5, each midportion 44 is transversely offset from both the forward end 41 and the rear end 43 of the respective tensile member 28 by a second offset distance D2 that is less than the first offset distance D1 when the sole structure 10 is dorsiflexed in the forefoot region 14.

Depending on the materials selected, and the thickness and length of each tensile member 28, the midportion 44 may be aligned with the forward portion 40 and the rear portion 42 at a flex angle within the second flexion range FR2, such that the tensile member 28 is straight along its center axis along its entire length. Alternatively, the tensile members 28 may only achieve a less curvilinear, but not fully straight position at the predetermined flex angle A1 (or even beyond the predetermined flex angle A1), as illustrated in FIG. 5. In either case, moving the midportions 44 of the tensile members 28 from the first offset distance D1 to the second offset distance D2 due to dorsiflexion causes the tensile members 28 to be placed in tension.

In the first portion of the flexion range FR1, tensile forces on the tensile members 28 are relieved by the ability of the tensile members 28 to move transversely while spanning the increasing distance between the front wall 32 and the rear wall 36. At a predetermined flex angle A1, however, the tensile members 28 reach a positon in which the forces of the first sole plate 12 at the front wall 32 and the rear wall 36 on the tensile members 28 do not significantly further straighten the tensile members 28 (i.e., don't move the midportions 44 relative to the forward portions 40 and the rear portions 42) and instead place the tensile members 28 under tension. FIG. 6 shows that the tensile members 28 are spaced apart from the ground-facing surface 21 of the first sole plate 12 by a vertical gap 45 when the sole structure 10 is in the unflexed, relaxed state. The vertical gap 45 is optional. The sole structure 10 could instead be configured so that the tensile members 28 lay directly against the ground-facing surface 21 in the opening 30 with no vertical gap in the unflexed, relaxed state. In either case, the tensile members 28 are not secured to the ground-facing surface 21 in the opening 30, and the tensile members 28 are thus suspended or "float" in the opening 30 below the ground-facing surface 21. Depending on the predetermined flex angle A1 and the height of an initial gap 45 above the tensile members 28 at the opening 30, the lower surface 21 of the sole plate 12 above the tensile members 28 may come into contact with an upper surface 47 of the tensile members 28 at the predetermined flex angle A1 or at a greater flex angle within the second range of flexion FR2, causing increased compression in the sole plate 12 above the tensile members 28, and increased tension in the tensile members 28 and a lower portion of the sole plate 12 connected thereto.

FIG. 7 shows that the first sole plate 12 and the tensile members 28 are configured so that the increased bending stiffness of the sole structure 10 occurs at a predetermined flex angle A1 shown in FIG. 7. Traction elements 69 are shown in FIGS. 5 and 6. The traction elements 69 may be integrally formed as part of the first sole plate 12, may be attached to the first sole plate 12, or may be formed with or attached to another plate underlying the first sole plate 12, such as if the first sole plate 12 is an inner board plate and the sole structure 10 includes an underlying outsole. For example, the traction elements 69 may be integrally formed cleats. In other embodiments, the traction elements may be, for example, removable spikes. The traction elements 69 protrude below the ground-facing surface 21 of the first sole plate 12. Direct ground reaction forces on the tensile members 28 that could affect the straightening of the tensile members are thus minimized. In other embodiments, however, the sole structure 10 may have no traction elements 69, the ground-facing surface 21 may be the ground-contact surface, or other plates or components may underlie the first sole plate 12.

The configuration of the tensile members 28 in the opening 30, and in a common plane P with the straightening motion of the midportions 44 being generally in a transverse direction with increasing dorsiflexion during the first portion of the flexion range FR1 enables compact packaging of the tensile members 28 within the profile of the first sole plate 12, with lower surfaces 49 of the tensile members 28 being aligned with the ground-facing surface 21 of the first sole plate 12 forward of and rearward of the tensile members 28). This compact packaging may be desirable in comparison to configuring the tensile members 28 to have a downward-bowing shape that extends below the ground-facing surface 21 that is forward of and rearward of the tensile members 28.

As will be understood by those skilled in the art, during bending of the first sole plate 12 as the foot 52 is dorsiflexed, there is a layer in the first sole plate 12 referred to as a neutral plane (although not necessarily planar) or a neutral axis above which the first sole plate 12 is in compression, and below which the first sole plate 12 is in tension. The increased tension on the lower portion when the tensile members 28 have moved to the straighter position and when the tensile members 28 possibly interfere with the ground-facing surface 21 in the opening 30 causes additional compressive forces CF on the first sole plate 12 above the neutral plane, and additional tensile forces TF on the first sole plate 12 below the neutral plane. At the first predetermined flex angle A1, which is the beginning of a second portion of the flexion range FR2, further dorsiflexion of the sole structure 10 causes a corresponding increase in resistance to flexion and bending stiffness of the sole structure 10.

With reference to FIG. 7, the first predetermined flex angle A1 is defined as the angle formed at the intersection between a first axis LM1 and a second axis LM2, where the first axis LM1 generally extends along a longitudinal midline LM at the ground-facing surface 21 of first sole plate 12 anterior to the opening 30 and the tensile members 28, and the second axis LM2 generally extends along the longitudinal midline LM at the ground-facing surface 21 of the first sole plate 12 posterior to the opening 30 and the tensile members 28. The first sole plate 12 is configured so that the intersection of the first and second axes LM1 and LM2 will typically be approximately centered both longitudinally and transversely below the tensile members 28 discussed herein, and below the metatarsal-phalangeal joints of the foot 52 supported on the foot-receiving surface 20. By way of non-limiting example, the first predetermined flex angle A1 may be from about 30 degrees)(°) to about 65°. In one exemplary embodiment, the first predetermined flex angle A1 is found in the range of between about 30° and about 60°, with a typical value of about 55°. In another exemplary embodiment, the first predetermined flex angle A1 is found in the range of between about 15° and about 30°, with a typical value of about 25°. In another example, the first predetermined flex angle A1 is found in the range of between about 20° and about 40°, with a typical value of about 30°. In particular, the first predetermined flex angle can be any one of 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, 60°, 61°, 62°, 63°, 64°, or 65°.

The sole structure 10 will bend in dorsiflexion in response to forces applied by corresponding bending of a user's foot at the MPJ during physical activity. Throughout the first portion of the flexion range FR1, bending stiffness (defined as the change in moment as a function of the change in angle) will remain approximately the same as bending progresses through increasing angles of flexion. Because bending within the first portion of the flexion range FR1 is primarily governed by inherent material properties of the materials of the first sole plate 12 and the tensile members 28, a graph of torque on the plate versus angle of flexion (the slope of which is the bending stiffness) in the first portion of the flexion range FR1 will typically demonstrate a smoothly but relatively gradually inclining curve (referred to herein as a "linear" region with constant bending stiffness). At the beginning of the second portion of the range of flexion FR1 and FR2, the maximum straightening of the tensile members 28 and the potential abutment of the upper surface 47 of the tensile members 28 with the ground-facing surface 21 in the opening 30 as discussed herein engages additional material and mechanical properties that exert a notable increase in resistance to further dorsiflexion (i.e., the first sole plate 12 above the tensile members 28 is placed under markedly increased compression, and a lower portion of the first sole plate 12 at which the forward and rear portions 40, 42 of the tensile members 28 are attached is placed under increased tension as a result).

Figure 8:
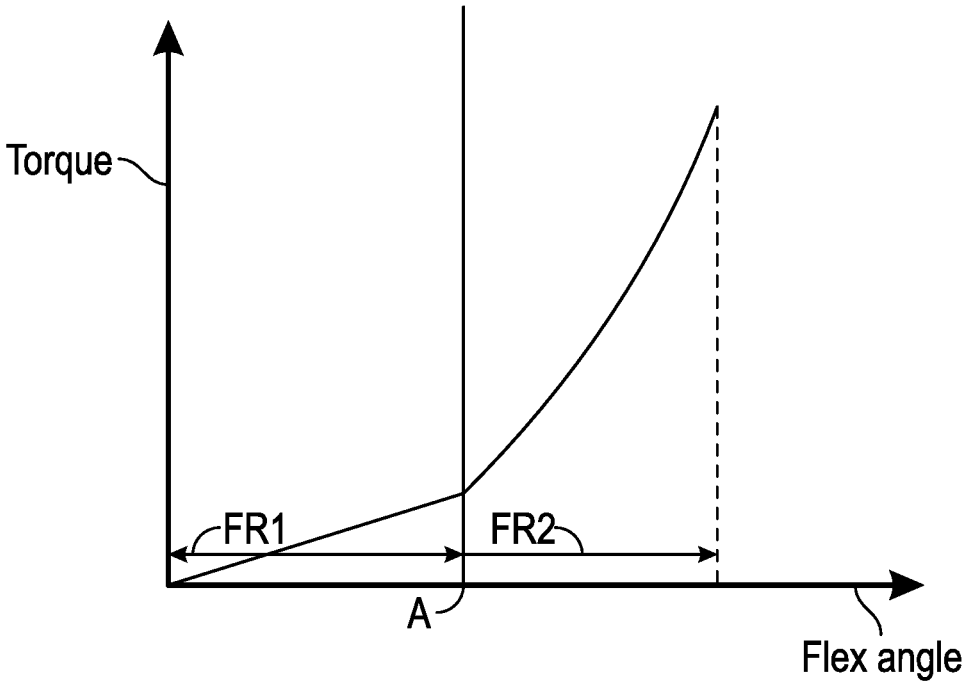
FIG. 8 is a plot of torque versus flex angle for the sole structure of FIGS. 1-7.

Therefore, a corresponding graph of torque versus angle of deflection (the slope of which is the bending stiffness) that also includes the second portion of the flexion range FR2 would show—beginning at an angle of flexion approximately corresponding to angle A1—a departure from the gradually and smoothly inclining curve characteristic of the first portion of the flexion range FR1. This departure is referred to herein as a "nonlinear" increase in bend stiffness, and would manifest as either or both of a stepwise increase in bending stiffness and/or a change in the rate of increase in the bending stiffness. The change in rate can be either abrupt, or it can manifest over a short range of increase in the bend angle of the sole structure 10. In either case, a mathematical function describing a bending stiffness in the second portion of the flexion range FR2 will differ from a mathematical function describing bending stiffness in the first portion of the flexion range. FIG. 8 is an example plot depicting an expected increase in resistance to flexion at increasing flex angles, as exhibited by the increasing magnitude of torque required at the heel region 18 for dorsiflexion of the forefoot region 14. The bending stiffness in the first range of flexion FR1 (i.e., the first bending stiffness) may be constant (thus the plot would have a linear slope) or substantially linear or may increase gradually (which would show a change in slope in FR1). The bending stiffness in the second range of flexion FR2 (i.e., the second bending stiffness) may be linear or nonlinear, but will depart from the bending stiffness of the first range of flexion FR1 at the first predetermined flex angle A1, either markedly or gradually (such as over a range of several degrees) at the first predetermined flex angle A1. The sole structure 10 thus provides a first bending stiffness in the first portion of the flexion range FR1, and a second bending stiffness greater than the first bending stiffness in the second portion of the flexion range FR2.

Functionally, when the first sole plate 12 is dorsiflexed in the first portion of the flexion range FR1, the tensile members 28 move to straighter positions, and the first sole plate 12 bends relatively freely. When the flex angle of the sole structure 10 reaches the first predetermined flex angle A1, longitudinally opposing tensile forces TF directed outwardly along the longitudinal midlines LM1 and LM2 can no longer be relieved by the straightening tensile members 28, as they would throughout the first portion of the flexion range FR1. Instead, further bending of the sole structure 10 is additionally constrained by the tensile member's 28 resistance to further straightening, and the portion of the first sole plate 12 above the tensile members 28 resistance to compressive shortening and deformation in response to the progressively increasing compressive forces CF applied along its longitudinal axis. Accordingly, the compressive and tensile characteristics of the material(s) of the first sole plate 12 and the tensile members 28 play a large role in determining a change in bending stiffness of the sole structure 10 as it transitions from the first portion of the flexion range FR1, to and through the second portion of the flexion range FR2.

With reference to FIG. 7, as the foot 52 flexes by lifting the heel region 18 away from the ground G while maintaining contact with the ground G at a forward portion of the article of footwear 11 corresponding with a forward portion of the forefoot region 14, it places torque on the sole structure 10 and causes the first sole plate 12 to flex at the forefoot region 14.

In addition to the mechanical (e.g., tensile, compression, etc.) properties of the selected material of the first sole plate 12, structural factors that likewise affect changes in bend stiffness during dorsiflexion include but are not limited to the thicknesses, the longitudinal lengths, and the medial-lateral widths of the first sole plate 12.

Figure 9:
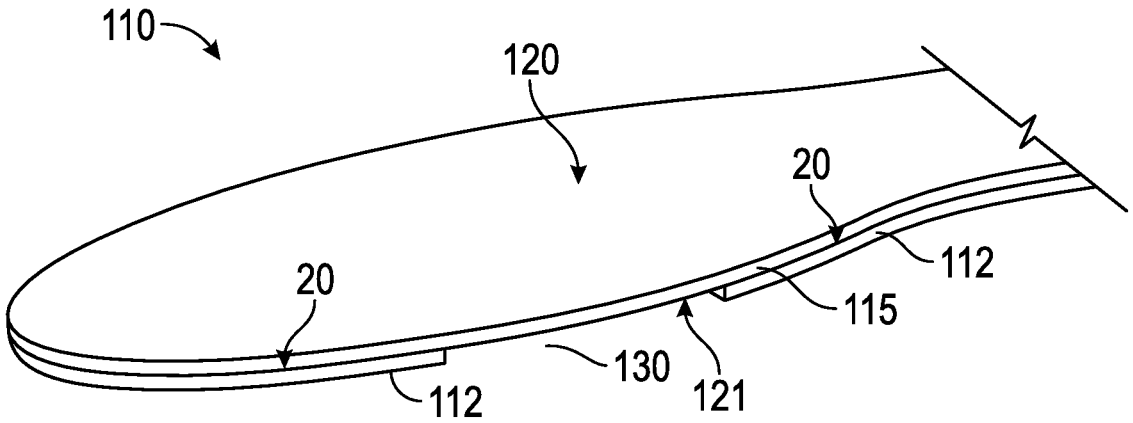
FIG. 9 is a schematic illustration in perspective view of an alternative embodiment of a sole structure for an article of footwear in an unflexed position in accordance with an alternative aspect of the present teachings.
Figure 10:
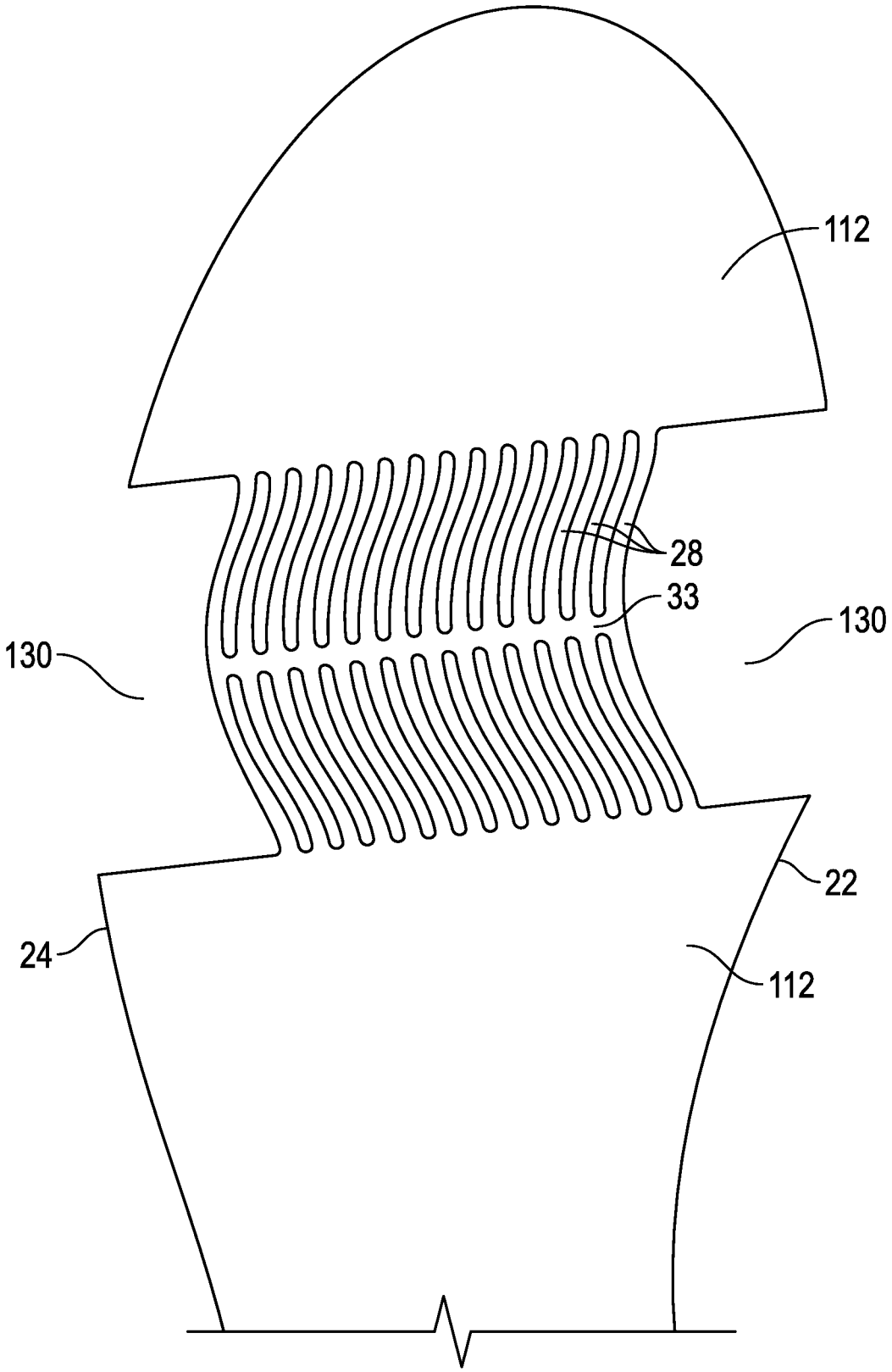
FIG. 10 is a schematic illustration in bottom view of a first sole plate of the sole structure of FIG. 9.

FIGS. 9 and 10 show an alternative embodiment of a sole structure 110 that includes a first sole plate 112 with an opening 130 that extends entirely there through. The sole structure 110 provides a nonlinear bending stiffness as shown and described with respect to FIG. 8. The sole structure 110 includes a second sole plate 115 operatively secured to the foot-receiving surface 120 of the first sole plate 12 such as by adhesive or friction welding to cover a top of the opening 130 as shown in FIG. 9. As used herein, the second sole plate 115 is "operatively secured" to the first sole plate 12 when it is directly or indirectly attached to the first sole plate 12. The foot-receiving surface 120 of the first sole plate 112 is covered by the second sole plate 115, but the foot 52 is still indirectly supported by the first sole plate 112 at the foot-receiving surface 120 when the foot 52 rests directly or indirectly on the foot-receiving surface 120 of the second sole plate 115. A lower surface 121 (also referred to as a ground-facing surface) of the second sole plate 115 is secured to an upper surface of the first sole plate 112 forward of the tensile members 28 and rearward of the tensile members 28 and extends across the opening 130 adjacent to and over the tensile members 28, covering the tensile members 28 from above. The tensile members 28 are not secured to the second sole plate 115, and can move relative thereto in the same manner as the tensile members 28 move relative to the first sole plate 12 as described with respect to FIGS. 1-7. The tensile members 28 may rest directly against the ground-facing surface 121 of the second sole plate 115 when the sole structure 110 is in the unflexed, relaxed state. Alternatively, a gap similar to gap 45 may exist between the tensile members 28 and the lower surface 121 of the second sole plate 115 above the tensile members 28 when the sole structure 110 is in the unflexed, relaxed position. The second sole plate 115 also has a forefoot region 14, a midfoot region 16, and a heel region 18. In other embodiments, either or both of the first sole plate 112 and the second sole plate 115 may be a partial length plate member. For example, in some cases, the first sole plate 112 may include only a forefoot region that may be operatively connected to other components of the article of footwear that comprise a midfoot region and a heel region.

Figure 12:
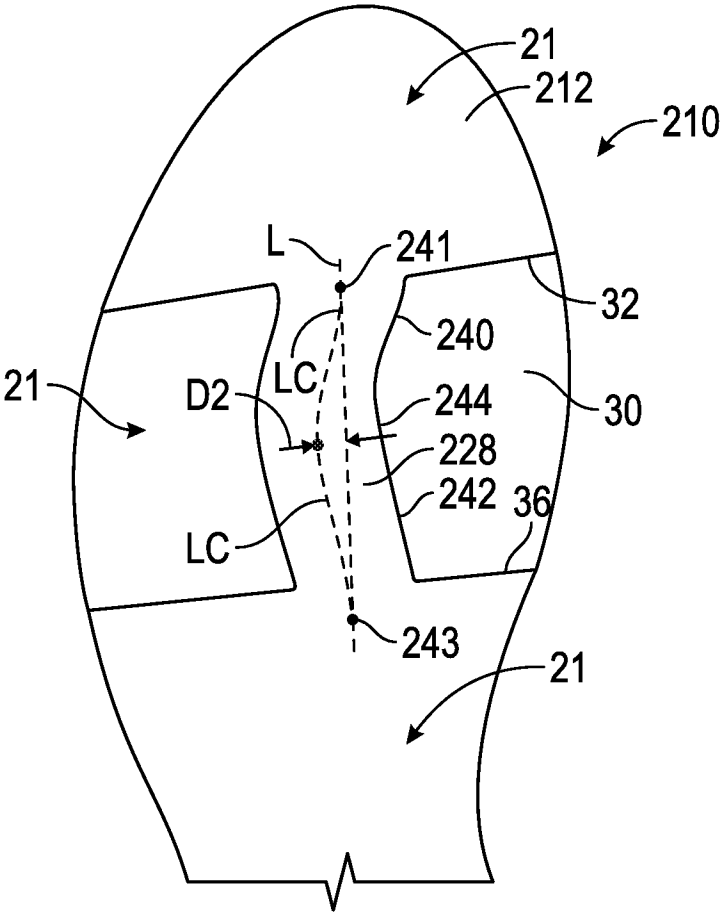
FIG. 12 is a schematic illustration in fragmentary bottom view of the sole structure of FIG. 11 in a flexed position.
Figure 11:
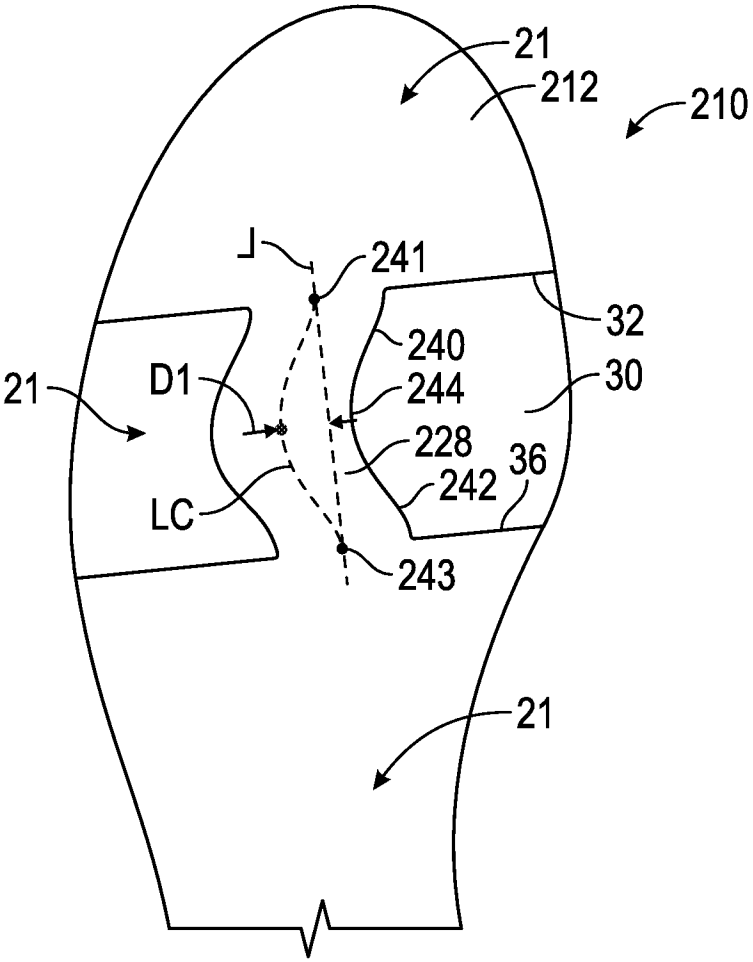
FIG. 11 is a schematic illustration in bottom view of another alternative embodiment of a sole structure for an article of footwear showing a single tensile member and in an unflexed position in accordance with an alternative aspect of the present teachings.

FIGS. 11 and 12 shows another alternative embodiment of a sole structure 210 in which a first sole plate 212 identical to the first sole plate 12 shown and described with respect to FIG. 1 is used, but with only a single tensile member 228 disposed in and spanning the opening 30. The sole structure 210 provides a nonlinear bending stiffness as described in FIG. 8. The tensile member 228 has a forward portion 240 with a forward end 241 fixed at the first wall 32, a rear portion 242 with a rear end 243 fixed at the second wall 36, and a midportion 244 that extends across the opening 30 from the forward portion 240 to the rear portion 242. The midportion 244 of the tensile member 228 is transversely offset from both the forward end 241 and the rear end 243 by a first offset distance D1 when the sole structure 210 is in an unflexed, relaxed state of FIG. 11 as described with respect to the tensile members 28 of FIG. 4. The midportion 244 of the at least one tensile member 228 is transversely offset from both the forward end 241 and the rear end 243 by a second offset distance D2 less than the first offset distance when the sole structure 210 is dorsiflexed in the forefoot region 14 such as shown in FIG. 12 as is evident by the further distance between the front wall 32 and the rear wall 36, which represents dorsiflexion at a first predetermined flex angle A1.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. A sole structure for an article of footwear comprising:

a first sole plate that includes:

a forefoot region;

a foot-receiving surface;

a ground-facing surface opposite the foot-receiving surface;

an opening in the ground-facing surface extending at least partway through the first sole plate, and extending from a lateral side of the first sole plate to a medial side of the first sole plate in the forefoot region;

a first wall at a forward extent of the opening;

a second wall at a rear extent of the opening;

a tensile member disposed in the opening, wherein the tensile member has a forward end fixed to the first wall, has a rear end fixed to the second wall, and extends across the opening from the forward end to the rear end;

wherein a midportion of the tensile member is transversely offset from both the forward end and the rear end by a first offset distance when the sole structure is in an unflexed, relaxed state, wherein the first wall and the second wall are configured to move apart from one another when the first sole plate is dorsiflexed, with the first wall tensioning the forward end of the tensile member and the second wall tensioning the rear end of the tensile member;

wherein the sole structure has a first bending stiffness in a first portion of a flexion range of the sole structure, and has a second bending stiffness greater than the first bending stiffness in a second portion of the flexion range;

wherein the second portion of the flexion range includes flex angles greater than in the first portion of the flexion range; and wherein the tensile member is secured to the first sole plate only at the forward end and at the rear end, and the midportion extends freely from the first sole plate and is suspended in the opening between the forward end and the rear end.

2. The sole structure of claim 1, wherein the midportion of the tensile member is transversely offset from both the forward end and the rear end toward the lateral side of the first sole plate.

3. The sole structure of claim 1, wherein the midportion of the tensile member is transversely offset from both the forward end and the rear end by a second offset distance less than the first offset distance when the sole structure is dorsiflexed in the forefoot region.

4. The sole structure of claim 1, wherein a longitudinal axis of the tensile member lies in a single plane from the forward end to the rear end when the sole structure is in the unflexed, relaxed state.

5. The sole structure of claim 1, wherein the tensile member is one of a plurality of tensile members, and further comprising:

a strut connected to midportions of two or more of the plurality of tensile members and extending transversely between adjacent ones of the two or more of the plurality of tensile members.

6. The sole structure of claim 5, wherein the strut is elongated and has a longitudinal axis generally parallel to each of the first wall and the second wall.

7. The sole structure of claim 6, wherein the plurality of tensile members is an array of equally spaced-apart tensile members.

8. The sole structure of claim 5, wherein each one of the plurality of tensile members is spaced apart from each other one of the plurality of tensile members.

9. The sole structure of claim 1, further comprising:

a second sole plate secured to the foot-receiving surface of the first sole plate both forward of the tensile member and rearward of the tensile member, and extending across the opening adjacent to the tensile member.

10. The sole structure of claim 1, wherein the tensile member is spaced apart from the ground-facing surface of the first sole plate in the opening when the sole structure is in the unflexed, relaxed state.

11. The sole structure of claim 1, wherein the first sole plate further includes a midfoot region.

12. The sole structure of claim 1, wherein the first sole plate is an outsole, a midsole, an insole, or a unisole.

13. The sole structure of claim 1, wherein:

the first portion of the flexion range includes flex angles of the sole structure less than a first predetermined flex angle;

the second portion of the flexion range includes flex angles of the sole structure greater than or equal to the first predetermined flex angle; and the sole structure has a change in bending stiffness at the first predetermined flex angle.

14. The sole structure of claim 1, wherein:

the first sole plate includes a medial side wall defining an outermost periphery of the first sole plate at the medial side and a lateral side wall defining an outermost periphery of the first sole plate at the lateral side; and the opening extends from the outermost periphery of the first sole plate at the medial side to the outermost periphery of the first sole plate at the lateral side.

15. The sole structure of claim 1, wherein the tensile member is the same material as the first sole plate and is uniformly formed therewith in a one-piece configuration.

16. A sole structure for an article of footwear comprising:

a sole plate that includes:

a forefoot region;

a foot-receiving surface;

a ground-facing surface opposite the foot-receiving surface;

a recess in the ground-facing surface extending only partway through the sole plate and from a lateral side of the sole plate to a medial side of the sole plate in the forefoot region;

a first wall at a forward extent of the recess;

a second wall at a rear extent of the recess;

a plurality of tensile members disposed in the recess, wherein each of the plurality of tensile members:

is fixed to the sole plate only at the first wall and at the second wall;

is suspended in and extends freely across the recess from the first wall to the second wall;

has a forward end fixed to the first wall and a rear end fixed to the second wall; and has a curvilinear posture with a transversely-offset midportion when the sole structure is in an unflexed, relaxed state;

wherein the first wall and the second wall are configured to move apart from one another when the sole plate is dorsiflexed, with the first wall tensioning the forward end and the second wall tensioning the rear end;

wherein the sole structure has a first bending stiffness in a first portion of a flexion range of the sole structure, and has a second bending stiffness greater than the first bending stiffness in a second portion of the flexion range; and wherein the second portion of the flexion range includes flex angles greater than in the first portion of the flexion range.

17. The sole structure of claim 16, wherein the transversely offset midportion is transversely offset from both the forward end and the rear end by a first distance when the sole structure is in the unflexed, relaxed state, and by a second distance less than the first distance when the sole structure is dorsiflexed in the forefoot region.

18. The sole structure of claim 16, further comprising:

a strut connected to each of the plurality of tensile members and extending transversely between two or more adjacent ones of the plurality of tensile members.

19. The sole structure of claim 16, wherein the plurality of tensile members is spaced apart from the ground-facing surface of the sole plate in the recess when the sole structure is in the unflexed, relaxed state.

* * * * *